United States Patent [19]

Eskridge et al.

[11] 3,989,866

[45] Nov. 2, 1976

[54] ANTISOILING CARPET HAVING TRIANGULAR POLYAMIDE PILE CONTAINING POLYSTYRENE FIBRILS

[75] Inventors: Brewster B. Eskridge; Boyce M. Lyon, both of Asheville, N.C.

[73] Assignee: Akzona Incorporated, Asheville, N.C.

[22] Filed: June 6, 1975

[21] Appl. No.: 584,781

Related U.S. Application Data

[62] Division of Ser. No. 404,547, Oct. 9, 1973, Pat. No. 3,903,348.

[52] U.S. Cl. ..... 428/92; 260/37 N; 260/39 R; 260/DIG. 17; 428/97; 428/397; 428/401

[51] Int. Cl.[2] ..... D02G 3/02; D02G 3/04; D04H 27/00

[58] Field of Search ..... 428/85, 92, 97, 397, 428/401, 394; 260/37 N, 39 R, 857 UN, DIG. 15, DIG. 17

[56] References Cited

UNITED STATES PATENTS 3,837,980 9/1974 Nishimura ..... 428/92

*Primary Examiner*—Marion E. McCamish
*Attorney, Agent, or Firm*—Francis W. Young; Jack H. Hall

[57] ABSTRACT

Disclosed herein are novel synthetic polyamide fibers of generally triangular cross-sectional area having fibrils of polystyrene dispersed throughout as a discontinuous phase. The polyamide fibers are especially useful because of their enhanced antisoiling properties and can be advantageously employed in carpets, upholstery coverings, etc., where soiling is a problem.

7 Claims, 2 Drawing Figures

ANTISOILING CARPET HAVING TRIANGULAR POLYAMIDE PILE CONTAINING POLYSTYRENE FIBRILS

CROSS-REFERENCE TO RELATED APPLICATION

This is a divisional application of Ser. No. 404,547, filed Oct. 9, 1973 now U.S. Pat. No. 3,903,348.

BACKGROUND OF THE INVENTION

It is well known that among the properties normally considered in the selection of synthetic fibers for use in textile products such as carpets and apparel is the degree to which the products show soiling. For example, it is known that clear fibers tend to magnify the presence of soil whereas opaque fibers such as those containing $TiO_2$ tend not to show soiling to the same extent.

However, the addition of delusterants to the polymer is accompanied by undesirable results. For example, the use of conventional delusterants, such as titanium dioxide, in filamentary structures results in poor light stability of the structure, particularly those containing large quantities of delusterant. Also, the light-fastness of certain dyes on many polymeric materials is impaired by the presence of the delusterants and, furthermore, upon exposure to sunlight, the filaments tend to develop an undesirable chalky appearance. The presence of delusterants in the polymer also reduces color clarity and optical depth of the filaments, giving the fabrics a chalky, washed out appearance. Due to the abrasive nature of the delusterant particles, excessive wear in processing equipment is experienced. In addition, uniform distribution of the delusterant in the polymer is difficult to achieve.

In seeking a solution, polyethylene oxide (PEO) has been introduced into the fiber in an attempt to introduce a certain amount of opacity into the fiber while retaining good dyeability. Unfortunately, PEO has been known to cause processing problems when used in nylon, especially in the extrusion stage due to the tendency of the PEO to act as a lubricant and thereby reduce extrusion pressures, which in turn necessitates operating the extruder at a faster rate in an attempt to compensate. What is needed, therefore, is an anitsoiling additive which does not adversely affect dyeability of the fiber and does not create problems during polymerization or subsequent processing of the fiber. Additionally, the antisoiling properties (i.e., the tendency to hide soiling by dirt, grease, etc.) must approach those demonstrated by presently available commercial yarns used in carpets, upholstery, and other areas where soiling is a problem.

IN THE FIGURES

DESCRIPTION OF THE INVENTION

The invention is a solid synthetic linear polyamide fiber having a generally triangular cross-sectional area. Dispersed within the fiber are fibrils (i.e., small discontinuous fibers) of an injection molding grade of polystyrene. Based on the total fiber weight, from about 0.10 to about 6.0%, is the polystyrene antisoiling additive.

The fibers of the invention are prepared by blending the polyamide with the polystyrene, e.g., by mixing chips of the two polymers in a tumble dryer, and extruding the resulting mixture through a Y-shaped spinneret orifice into a medium (e.g., air) which sets or fixes the extruded material in the shape desired. This general process is elaborated upon in some detail in U.S. Pat. No. 3,382,305. The spinning conditions used, e.g., melt or solution temperature, the quenching conditions, and the viscosity of the material being extruded, can be readily selected by those skilled in the art to provide the novel fibers. Spinning conditions must, of course, be varied depending on the particular synthetic polymer blended with the polystyrene. The conditions should be controlled to provide filaments having a substantially uniform shape along their length. Following spinning, the fibers may then be wound, drawn, and texturized by conventional methods. In processing the fibers by the above method, it has been discovered that in the extrusion stage, the polymer blend can be satisfactorily extruded at good speeds (e.g., 400 meters/minute) while maintaining relatively uniform polymer pressures at the extruder head. Also, extrusion proceeds with little or no polymer dripping and the resultant fibers have been found to have a relatively uniform cross-sectional configuration.

While the foregoing processing advantages are of critical importance, it is of utmost significance that the polystyrene-modified fibers exhibit antisoiling properties approaching those of commercial antisoil fibers presently available. Much of this advantage is believed to be attributable to the use of injection molding grades of polystyrene which have a sufficiently high viscosity that the polystyrene is relatively uniformly distributed throughout the fiber and is in the form of fibrils rather than globules, such as result where non-molding grades of polystyrene are employed. The polystyrene-modified fibers are readily plied into yarns which can be bulked and tufted to form a variety of carpets. When employed in carpets, it has been found that the fibers show good ability to accept commonly employed dyes while also retaining a significant amount of opacity so that good antisoiling properties are present.

Figure 1:
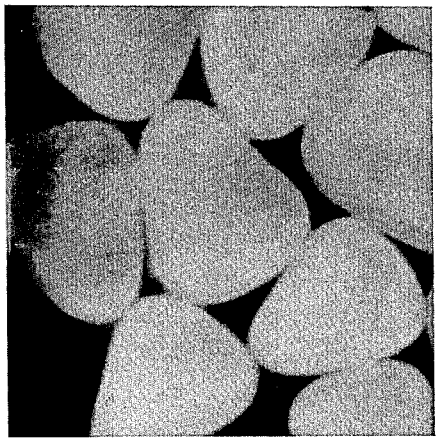
FIG. 1 is a photomicrograph (magnification ~650X) of cross-sections showing polyamide (nylon 6) filaments of generally triangular cross-section but which do not contain the polystyrene antisoiling additive.
Figure 2:
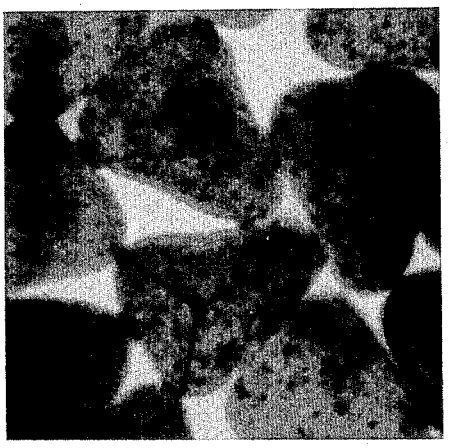
FIG. 2 is a photomicrograph (magnification ~650X) of cross-sections as in FIG. 1 but which contain in addition fibrils of polystyrene, the cross-sections of which are indicated by the black "dots."

Preferably, the antisoiling fibers of the invention will have a generally triangular cross-sectional area as depicted in FIG. 2. It has been found that this configuration provides good reflectance and imparts to the fibers as "brightness" or "sparkle" which is valued by the purchases of carpets. With reference to FIGS. 1 and 2, both of which show the generally triangular cross-sectional area of fibers of the invention, it will be noted that three axes of the cross-section resemble a "Y" with two legs substantially equivalent while the third is somewhat longer. In this sense, the cross-sectional area resembles an isoceles triangle, and is only symmetrical when viewed along an axis proceeding along the longer leg of the Y, and along all other axes, the cross-section is, therefore, generally asymmetric. This type of triangular asymmetric configuration is frequently described as a "candy-corn" configuration. In addition to the asymmetric configuration, other generally triangular configurations which can be employed include symmetrical triangular cross-sections such as the "trilobal" configuration described in U.S. Pat. No. 2,939,201.

As indicated above, the polyamide fibers of the invention have dispersed therein from about 0.1 to about 6.0% (based on the total polymer weight) of polystyrene. Preferably, the weight range of polystyrene is from about 1 to about 4%. Of the wide range of polystyrene materials available, the invention employs an injection molding grade of polystyrene having a molecular weight range of from about 60,000 to about 100,000. Suitable examples of such materials include:

Styron 690 (the Dow Chemical Company)
Lustrex HF-55 (Monsanto Company)
Duratron PS (Shell Oil Company) and
Dylene KPD 1025 F (Sinclair-Koppers Company)

The dispersing of the polymers can be done in a conventional manner, for instance, by mixing the dry powders or flakes of the polymers and melting this mixture or, by melting the polymers separately and mixing them in the molten state. Fine dispersion of the polystyrene in the polyamide material can be promoted by rapidly stirring, shaking, or other means and is further promoted by filtering the melt before extruding through the customary sand filters or similar devices. By one or more of these means, dispersions approaching colloidal dimensions can easily be obtained. In general, the time of contact of the two polymers in the molten dispersed form is only a few seconds to a few minutes.

The melt dispersions may be spun into room temperature air for solidification, or the temperature may be raised or lowered depending, in part, upon the properties of the melt dispersion. Generally, room temperature is used for the convenience it affords, and the filaments travel about 25 feet between the spinneret and wind-up. A transverse air stream or other quenching means may be used, if desired.

Drawing or stretching of the composite fibers may be carried out while or after spinning as is commonly known. The common devices may be used, for instance, stretching between hot or cold rolls driven at different speeds. The draw ratios applied may vary widely. Generally, it is sufficient to after-stretch or draw the spun composite fiber 3 to 5 times its original length.

Following extrusion, the solid continuous filaments are characterized in that the polystyrene is uniformly dispersed in the form of fibrils, throughout the polyamide, which is the continuous phase. The fibrils should have a diameter of about 0.01 microns to about 3 microns. The ratio of the length to the width should be more than 20 and can be as much as 10. Upon exposure to a polyamide solvent, such as formic acid, the continuous polyamide phase can be removed. The residue has been found to consist of an interlaced network or web of polystyrene fibrils.

As is commonly known, the orientation and improvement of physical properties of fibers is mostly brought about by stretching at room temperatures or at temperatures considerably below the melting temperature of the polymer. The original particles of polystyrene forming the microfiber in the melt dispersion, which are thought to be substantially spherical, are attenuated considerably in the spinning process. This attentuation, together with the after-stretch or draw, determines the length-width ratio of the final fibril, the volume of which is substantially equivalent to or less than (due to shrinkage) the volume of the original dispersed polystyrene particle in the melt. Concerning the phenomenon of shrinkage, it has been found that on cooling, the fibrils contained in the polyamide may shrink to as little as 50% of their original length in the freshly drawn state, with the degree of shrinkage relating somewhat to the location of the fibril in the fiber and the consequent speed with which cooling takes place. After shrinkage, it has been found that voids remain in the polyamide fibers which are believed also to contribute significantly to soil hiding properties. When analyzed microscopically, the fibrils are from 1 to 2 microns in diameter and from 1 to 10 microns in length (average 5). When the presence of voids is considered, the length (fibril plus void) appears to be from 3 to 15 microns with the average being about 10 microns. While the preceding fibril dimensions contemplates a total weight of polystyrene of about 1%, which has been found to provide satisfactory soil hiding properties, with increasing weights of the polystyrene in the melt, the attenuated particles or fibrils, while still in the molten or softened state in the spinning operation, may flow together. This may result in considerably increased length compared with the diameter, e.g., diameters of up to 4 microns or so, with length up to 50 microns. These latter dimensions are not intended to be limiting in that the essence of the invention resides in the presence of the fibrils and their beneficial effect on processing and soil hiding properties, rather than upon their size.

EXAMPLE

This example illustrates the preparation of antisoiling nylon carpet yarn containing polystyrene according to the invention.

Polystyrene chips were blended for 30 minutes in a tumble dryer at room temperature with nylon 6 chips. The total batch contained 1% by weight of polystyrene chips based on the weight of the nylon chips. The polystyrene (Styron 690, a type of polystyrene manufactured by the Dow Chemical Company) had a melt viscosity of 6500 poise, a softening point of 105° C., a specific gravity of 1.04, and a refractive index of 1.58. The average molecular weight was about 80,000. The nylon 6 chips did not contain $TiO_2$.

The polymer blend thus prepared was melted and blended in an extruder (1½ inches diameter) and was extruded through a filter pack and a 68 hole spinneret. The configuration of each spinneret was an asymmetric Y with first and second legs being generally 400 microns in length and the third leg being 700 microns in length. The resulting filaments exhibited the generally asymmetric triangular cross-section of FIG. 1. The filaments were quenched, wound up, and drawn (3.7×) to produce filaments of approximately 15 denier. The total filament bundle constituted a feeder yarn of 1040/68 denier. Two ends of feeder yarn were combined and bulked (using a stufferbox followed by air tangling) to produce a bulked yarn of approximately 2500 denier.

By the techniques described above, a control yarn was prepared which did not contain polystyrene. The yarn was essentially similar to the polystyrene-modified yarn with the exception that the bulk of the polystyrene yarn was higher whereas the strength was less. These characteristics are set forth in the following table.

TABLE I

| | Polystyrene-modified Yarn | Control Yarn |
|---|---|---|
| Drawn Yarn | | |

TABLE I-continued

| | Polystyrene-modified Yarn | Control Yarn |
|---|---|---|
| Tenacity, gpd | 4.3 | 4.2 |
| Denier | 1090 | 1080 |
| Elongation at Break | 40 | 43 |
| Bulked Yarn | | |
| Wet bulk | 19 | 14 |
| Dry bulk | 8 | 6 |
| Crimp/inch | 14 | 11 |
| Denier | 2560 | 2470 |
| Tenacity, gpd | 2.6 | 3.3 |
| Elongation at Break | 45 | 56 |

Both the polystyrene-modified yarn and the control yarn were passed through a conditioning (mock dyeing) solution to simulate dyeing, and were tufted into greige carpet having a polyurethane backing. The samples were tested for soiling by being placed, as a carpet, in a heavily traveled corridor of an industrial office building. Prior to soiling, the control carpet samples had an average brightness (Y) value of 62.1 as measured by a Photovolt photoelectric reflection meter (Model 610). The value for the polystyrene modified samples was 66.5.

After being placed in the corridor, the samples were vacuumed once a day at which time the brightness was again read with the photoelectric cell. The values obtained, together with the approximate number of foot-passes to which the samples were subjected, are set forth in Table II below. The figure for "degree of soiling" was obtained by use of the formula:

$$\text{Degree of soiling} = \frac{Ro - Rs}{Ro} \times 100 \text{ where}$$

Ro is original reflectance (or brightness)
Rs is the brightness after soiling

TABLE II

| Carpet Type | Thousands/ Foot Passes | Degree of Soiling | | | Average Index |
|---|---|---|---|---|---|
| | 6 | 11 | 14 | 20 | |
| Conrol (nylon without additive) | 34.8 | 32.2 | 40.4 | 40.8 | 38.6 |
| 1 % Polystyrene | 26.6 | 35.7 | 39.5 | 41.9 | 35.3 |
| Conventional Soil-hiding Carpet (Enkalure or Antron) | 30.1 | 33.5 | 37.7 | 39.5 | 35.5 |

In Table II, the conventional soil hiding carpet was a nylon 6 carpet wherein the soil hiding additive was 2% NX-133, a high molecular weight polyethylene oxide polymer manufactured by Union Carbide. These carpet samples were otherwise the same and were processed similarly to the control and the polystyrene modified samples.

In interpreting the figure for degree of soiling, to the extent that the value of Rs, the reflectance or brightness after soiling, is large, the difference (Ro − Rs) will be reduced accordingly. Therefore, relative success in hiding soil is indicated by a low figure for degree of soiling. From Table II, it can be seen that the polystyrene-modified carpet samples consistently exhibited less soiling than the control carpet samples. The polystyrene was also generally equivalent to the conventional soil-hiding carpet.

Polystyrene was also incorporated into polymer blends formulated by conventional methods to yield light, deep, and cationic dyeable polymers. The resulting fibers were wound, drawn, and bulked. Three ends, one deep dyeable, one light dyeable, and one cationic dyeable were plied together to form multidyeing yarn which was tufted to form a carpet. Upon dyeing to a gold shade, samples of the carpet were evaluated and were found to be sufficiently similar to commercially available anti-soil carpets so as to be competitive therewith.

In a similar manner, polyamide (nylon 6) was prepared wherein the antisoiling additives were polyethylene glycol (2.0%) and a conventional polyethylene (1.0%). The polyethylene glycol had a molecular weight of about 30,000. The additives were cold-blended with the polyamide in a dryer. Upon attempting to extrude the polymer blend, severe problems developed which included low polymer pressure at the extruder head, pressure fluctuation, high extruder screw-RPM, which was encountered in attempting to compensate for the reduced polymer pressure, polymer dripping, and extremely poor yarn cross-sections due to variations in pressure and difficulty in controlling polymer extrusion rates.

In a second trial, polystyrene was employed at the 1.0% level in place of the polyethylene glycol and polyethylene combination. The resulting blend was satisfactorily extruded at 400 meters/minute. At the extruder head, uniform polymer pressure of 1500 p.s.i. was maintained, no dripping was experienced, and uniform fiber cross-section was obtained. The yarn was wound without difficulties and three ends were plied during drawtwisting to form a yarn of good quality.

The polyamides useful in the present invention comprise polymers which have recurring amide groups and which are known to form fibers. The polyamides comprise such polymers as are described, for instance, in U.S. Pat. Nos. 2,071,251 and 2,071,253. The polyamides may be further exemplified by commercially available polymer materials such as Nylon 66, Nylon 6, Nylon 10, Nylon 12, and Nylon 610.

In preparing the filaments of this invention, various known textile adjuvants may be included in the polyamide, e.g., dyes, plasticizers, etc. In processing the filaments, slight variations in configuration may be introduced without impairing their desirable properties, e.g., the corner areas may not be uniformly rounded as shown in FIG. 2. Other slight distortions may also be introduced into the filament during spinning or processing operations such as drawing, crimping, twisting, dyeing, or bulking.

Novel fibers and filaments of this invention may be employed to produce a wide variety of different types of fabrics including both apparel and industrial textile products. The filaments and fibers of this invention are particularly useful in preparing various types of carpeting, e.g., woven, tufted, chenille, Smyrna, Wilton, Saxony, Brussels, velvet, Axminster, orientals, knitted, pleated, and the like due to the particular properties which the filaments and fiber of this invention exhibit.

What is claimed is:

1. A carpet having enhanced ability to obscure soiling wherein yarn in the pile of the carpet is formed of synthetic linear polyamide fibers having a generally triangular cross-sectional area and having, on a weight basis, from about 0.1 to about 6% of an injection molding grade polystyrene dispersed therein in the form of fibrils having a cross-sectional diameter of from about 1 to 4 microns.

2. A carpet as in claim 1 wherein the polyamide is nylon 6.

3. A carpet as in claim 2 wherein the injection grade polystyrene has an average molecular weight of about 80,000.

4. A carpet as in claim 1 having dispersed therein about 1 to 2 weight percent polystyrene.

5. A carpet as in claim 1 wherein the cross-sectional fiber area resembles an isoceles triangle with the corners being rounded.

6. A carpet as in claim 1 wherein the fiber is trilobal.

7. A carpet as in claim 1 where upon removing the fibers from the carpet and subjecting these to a solvent for the polyamide, the residue is an interlaced web of polystyrene fibrils.

* * * * *